US006759651B1

(12) United States Patent
Li

(10) Patent No.: US 6,759,651 B1
(45) Date of Patent: Jul. 6, 2004

(54) ION GUIDES FOR MASS SPECTROMETRY

(75) Inventor: Gangqiang Li, Palo Alto, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/405,145

(22) Filed: Apr. 1, 2003

(51) Int. Cl.[7] ..... H01J 49/04
(52) U.S. Cl. ..... 250/288; 250/396 R; 250/292; 250/293; 250/290
(58) Field of Search ..... 250/288–396 R, 250/292, 293, 290

(56) References Cited

U.S. PATENT DOCUMENTS 5,572,035 A * 11/1996 Franzen ..... 250/396 R
6,515,279 B1 * 2/2003 Baykut ..... 250/285

OTHER PUBLICATIONS

G.Weiss et al. "Travelling Field for Packaging Ion Beams", Pub. No: US 2002/0148959 A1, published Oct. 17, 2002.*

* cited by examiner

*Primary Examiner*—John R. Lee
*Assistant Examiner*—Zia R. Hashmi

(57) ABSTRACT

Ion guides and systems and methods for involving the use of ion guides are disclosed. Briefly described, one exemplary system, among others, includes an ion guide. The ion guide includes a first structure and a second structure. The second structure is coaxially disposed within the first structure. The second structure includes at least three groups of opening the through a wall of the second structure that are distributed around a circumference of the second structure. In addition, at least one of the group of openings is offset from the other groups of openings by a multiple of a constant rotation angle around the circumference of the second structure.

24 Claims, 7 Drawing Sheets

ION GUIDES FOR MASS SPECTROMETRY

BACKGROUND

A mass spectrometry system is an analytical system used for quantitative and qualitative determination of the compounds of materials such as chemical mixtures and biological samples. In general, a mass spectrometry system uses an ion source to produce electrically charged particles such as molecular and/or atomic ions from the material to be analyzed. Once produced, the electrically charged particles are introduced to the mass spectrometer and separated by a mass analyzer based on their respective mass-to-charge ratios. The abundance of the separated electrically charged particles is then detected and a mass spectrum of the material is produced. The mass spectrum is analogous to a fingerprint of the sample material being analyzed. The mass spectrum provides information about the mass-to-charge ratio of a particular compound in a mixture sample and, in some cases, molecular structure of that component in the mixture.

The molecular weight of a compound is often determined by the use of a mass spectrometry system having a single mass analyzer. The mass analyzer may include a quadrupole (Q) mass analyzer, a time-of-flight mass analyzer (TOF-MS), an ion trap mass analyzer (IT-MS), etc. Tandem mass spectrometers (i.e., tandem-MS or MS/MS) are often needed to analyze samples having complicated molecules. Tandem mass analyzers typically include two mass analyzers of the same or different type (e.g., TOF-TOF MS and Q-TOF MS).

In a tandem mass spectrometric analysis, electrically charged particles are transmitted to the first mass analyzer and an ion of particular interest is selected. The selected ion is transmitted to a dissociation cell where the selected ion is fragmented. The ionic fragments of the dissociated ion are transmitted to the second mass analyzer for mass analysis. The fragmentation pattern obtained from the second mass analyzer is then analyzed to determine the structure of the corresponding molecule.

There are challenges in building a high performance mass spectrometer such as a mass spectrometer having high sensitivity, high resolution, high mass accuracy, and wide dynamic range. One challenge is how to efficiently use sample material, which includes maximizing ionization efficiency and then efficiently transmitting formed ions into a mass analyzer.

However, for many mass spectrometric applications, high loss occurs when transmitting ions from a high-pressure region where ions are usually generated, to a low pressure region in the mass analyzer. This ion loss is a result of relatively long distances needed for differential pumping stages and of ion-molecule collision with a background gas when ions travel this distance. This is especially found in situations where ions are generated at atmospheric pressure or relatively high gas pressure. Such applications include, for example, electrospray ionization mass spectrometer (ESI-MS), atmospheric pressure chemical ionization mass spectrometer (APCI-MS), atmospheric pressure matrix assistant laser desorption/ionization (AP-MALDI), inductively coupled plasma mass spectrometry (ICP-MS) and glow discharge mass spectrometry (GDMS).

Ion optic devices have been used for transmitting charged particles and manipulating a beam of charged particles. In particular, ion optic devices have been used, for example, for focusing or defocusing of a beam of charged particles and for changing the particle energy and the energy distribution of the beam. Prior approaches to the above devices generally can be divided into two categories. Some known devices use magnetic fields or electrostatic fields in various configurations. Such devices include, for example, electrostatic einzel lenses, multipole lenses and electrostatic or magnetic sector fields. Other known devices use a radio frequency (RF) electrical field such as that employed in RF multipole ion guides and RF ion funnels, which consist of a series of ring electrodes. In comparison to those approaches that employ an electrostatic field, ion optic devices using a RF field offer significantly higher transmission efficiency and the ability to modify ion energy by collisional cooling when utilized with a gas of intermediate pressure. Another advantage is the use of the RF field for collisional induced dissociation (CID) to produce fragment species from molecular ions, which is an important tool for study of molecular structure. In commercial mass spectrometric instruments, RF multipole ion guides are widely used.

In collision induced dissociation, a multipole ion guide also acts as a collision cell. When molecular or polyatomic ions collide with the background gas (normally an inert gas), a portion of the translation energy of the ions converts into activation energy that is sufficiently high enough and certain molecular bonds are broken. The fragment pattern produced characterizes the original molecule and provides information about its structure. In such applications, a multipole ion guide is placed between two mass spectrometers to form a tandem MS and is used to confine both the parent ions and the fragments of the parent ions otherwise referred to as daughter ions. Confinement of the ions is generally realized by use of an oscillating electrical potential field.

A conventional electric RF multipole ion guide may be constructed by using several (even numbers) circular electrically conductive rods of identical geometric dimension arranged parallel around the central axis of the multipole ion guide. When radio frequency voltages of opposite polarities, $U+V\cos(\omega t)$ and $-[U+V\cos(\omega t)]$ are alternately applied to the adjacent rods, a symmetric RF field is established inside the radius of the multipole ion guide. In accordance with the numbers of rods, such fields are classified as quadrupole, hexapole and octopole, and so forth, for four rods, six rods and eight rods, respectively. At any cross section of the RF multipole field, the potential distribution is a function of time and is characterized by the RF frequency ($\omega$).

An ion beam sent axially trough the multipole field experiences a transverse force, which varies in time and space. It can be shown that the motion of the ions in such a field is harmonic. Due to such oscillation, ions are forced to "stay" inside of the inner circus of the multipole structure while traveling through the multipole structure. Consequently, the ion beam can be transmitted over a long distance without significant loss, which is essential for achieving high instrument sensitivity.

However, there is a need in the industry for a high performance device, which efficiently facilitates ion transmission, cooling, and/or focusing. In addition, there is a need for a device which offers high fragmentation efficiency for large organic or biomolecules. These and/or other shortcomings are addressed herein

SUMMARY

Ion guides and systems and methods for involving the use of ion guides are disclosed. Briefly described, one exemplary system, among others, includes an ion guide. The ion guide includes a first structure and a second structure. The second structure is coaxially disposed within the first structure. The second structure includes at least three groups of openings through a wall of the second structure that are distributed around a circumference of the second structure. In addition, at least one of the groups of openings is offset from the other groups of openings by a multiple of a constant rotation angle around the circumference of the second structure.

An exemplary method of focusing, among others, can be broadly summarized by the following steps: forming an oscillating electric potential field having predetermined characteristics, forming a rotating electric potential field superimposed on the oscillating electric potential field having predetermined characteristics, and introducing, the ions to the oscillating electric potential field and the rotating electric potential field.

Other systems, methods, features and/or advantages of the present invention will be or become apparent to one with skill in the art upon examination of the following drawings and detailed description. It is intended that all such additional systems, methods features, and/or advantages be included within this description and be protected by the accompanying claims.

BRIEF DESCRIPTION OF THE DRAWINGS

The components in the drawings are not necessarily to scale. Moreover, in the drawings, like reference numerals designate corresponding parts throughout the several views.

DETAILED DESCRIPTION

As will be described in detail here, radio frequency (RF) ion guides capable of producing a longitudinal harmonic electric field superimposed with a rotating electric field are provided. Such a RF ion guide can be used in a mass spectrometry system in which charged particles can be analyzed qualitatively and quantitatively. The electric fields cause charged particles traveling through the RF ion guide to undergo helical rotation overlapped with a harmonic oscillation. Such a RF ion guide can be used to efficiently transmit, focus, and/or cool the charged particles as they traverse the RF ion guide. In addition, embodiments of a RF ion guide can be used to control the fragmentation process of large molecules such as biomolecules. Mass spectrometry systems using embodiments of the RF ion guide can achieve higher sensitivity, higher resolution, and/or higher mass accuracy over a wider dynamic range than many currently used ion guides.

Figure 1:
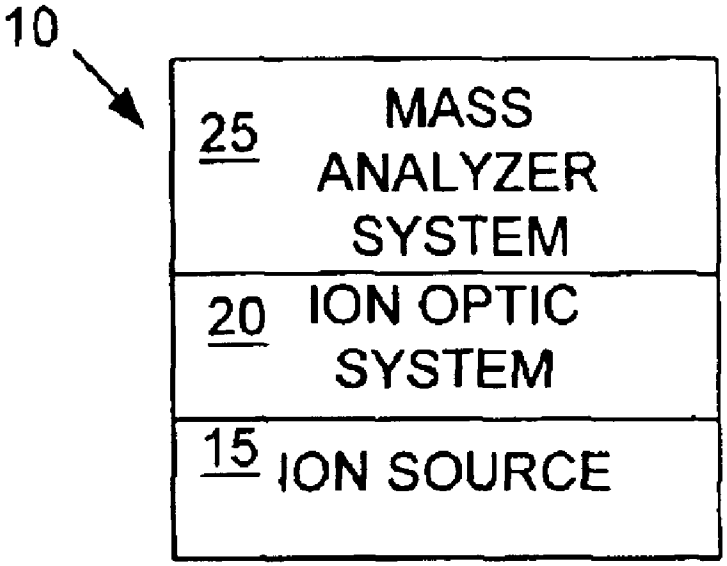
FIG. 1 is a schematic diagram of an embodiment of a mass spectrometry system.

FIG. 1 depicts an embodiment of a RF ion guide implemented into a mass spectrometry system 10. The mass spectrometry system 10 includes an ion source 15, ion optic system 20, and mass analyzer system 25. The ion source 15 can include ion sources under vacuum or at atmospheric pressure. For example, the ion source 15 can include sources such as, but not limited to, electrospray ionization source, atmospheric pressure chemical ionization source, inductively coupled plasma ion source, glow discharge ion source, electron impact ion source, and laser desorption/ionization ion source.

Initially, ions in the form of a packet of ions or a constant stream of ions are produced in the ion source 15. Subsequently, the ions are transferred via the ion optic system 20 into the mass analyzer system 25. The ions are separated in the mass analyzer system 25 according to their mass-to-charge ratio and detected based on their relative abundance.

The mass analyzer system 25 includes a mass analyzer. The mass analyzer system 25 can include a mass analyzer such as, for example, a time-of-flight (TOF) mass analyzer, an ion trap mass analyzer (IT-MS), a quadrupole (Q) mass analyzer, a magnetic sector mass analyzer, or an ion cyclotron resonance (ICR) mass analyzer. In some embodiments, because it can be used to separate ions having very high masses, the mass analyzer is a TOF mass analyzer.

In addition, the mass analyzer system 25 includes an ion detector. The ion detector is a device for recording the number of ions that are characterized by an arrival time or position in a mass analyzer system 25, as is known by one skilled in the art. Ion detectors can include, for example, a microchannel plate multiplier detector, an electron multiplier detector, or a combination thereof. In addition, the mass analyzer system 25 includes vacuum system components and electronic system components, as are known by one skilled in the art.

The ion optic system 20 transmits and/or manipulates ions within the mass spectrometry system 10. The ion optic system can include, but is not limited to, electrostatic elements and radio frequency (RF) elements. In particular, the ion optic system 20 of the mass spectrometry system 10 includes a RF ion guide capable of producing a longitudinal harmonic electric field superimposed with a rotating electric field.

In general, an exemplary RF ion guide includes an inner structure and an outer structure that are electrically isolated from each other. The outer structure and the inner structure are substantially hollow. The inner structure is disposed within the outer structure. The inner structure and the outer structure are adapted to receive independent electrical voltages. The inner structure includes a plurality of openings in the wall of the inner structure, which will be described in more detail below.

Applying electric voltages to the inner structure and the outer structure produces longitudinal harmonic electric fields superimposed with rotating electric fields having predetermined characteristics. The predetermined characteristics are related to the magnitudes of the voltages applied to the inner structure and the outer structure, the shapes and dimensions of the inner structure and the outer structure, and the alignment of the second hollow structure with respect to the first hollow structure. In addition, the number, dimensions, and positions of openings in the inner structure affect the predetermined characteristics of the longitudinal harmonic electric fields superimposed with rotating electric fields.

By way of example, radio frequency voltages of opposite polarities, $V_{in}=U_1+V_1\cos(\omega t)$ and $V_{out}=-[U_2+V_2\cos(\omega t)]$, may be applied to the inner structure and the outer structure, respectively. In the above equations, $V_{in}$ is the applied voltage on the inner structure, $U_1$ is the applied DC voltage, $V_1$ is the amplitude of the applied RF voltage, $\omega/2\pi$ is frequency in Hertz, t is elapsed time, $V_{out}$ is the applied voltage on the outer structure, $U_2$ is the applied DC voltage, and $V_2$ is the amplitude of the applied RF voltage. Typically, the absolute value of the voltage applied to the outer structure is higher than that applied to the inner structure (i.e., $U_2>U_1$ and $V_2>V_1$ (however, $U_1$ and/or $U_2$ may in fact be equal to zero and $V_2$ or $V_1$ may be equal to zero)). The electric potential generated by the voltage of the outer structure penetrates into the inner structure through the openings, together with the potential generated by the inner structure, to form a potential electric field of alternating polarity. Typical parameters are, for example, $\omega/2\pi$=about 200 kilohertz (kHz) to about 10 megahertz (MHz), $U_1$ and $U_2$=about 0 to about ±20 volts, $V_1$ and $V_2$=about ±400 volts. However, the maximum voltages applied can be as high as $U_1$ and $U_2$=about ±100 volts, $V_1$ and $V_2$=about ±1000 volts.

The terms "applying voltages," "voltages applied" and "application of electrical voltages" and the like refer to the directing of electrical potential to the inner structure and the outer structure to produce a difference in electrical potential. The terms include the maintaining of one of the structures at ground and direction of electrical potential to the other hollow structure to produce a difference in electrical potential.

The terms "electric potential" and "electric field" are used herein with their conventional meanings. As is known in the art, a force is exerted on the ion by an electric field and that force is equal to the electric field at the position of the ion multiplied by the electric charge on the ion. At any point in the electric field, a vector function of position can be derived from the potential, a scalar function of position, at that point; the field is the negative gradient of the potential. A third term, "electric potential field," is also used herein and refers to an electric potential in a region of space that is a function of position in the region. Electric potential fields are illustrated herein by equipotential lines in the manner conventional in the art. A fourth term, "sub-field," is used herein to describe a region within an electric potential field. A sub-field exhibits a pattern of equipotential lines that is similar to those in other sub-fields of the electric potential field.

The inner structure includes at least three regions along the longitudinal axis of the inner structure. The inner structure is divided into regions based on the position with respect to the longitudinal axis of the inner structure. The inner structure can be of unitary construction or constructed of discrete segments. The inner structure can be constructed so that the regions are electrically interconnected or the inner structure can be constructed so that the regions are electrically isolated. The number of regions depends on the total length of the ion guide and can range from 3 to 300 regions, 3 to 100 regions, and 3 to 30 regions.

Each region includes at least two openings through the wall of the inner structure. The openings are elongated and annularly disposed with respect to the longitudinal axis of the inner structure and are substantially evenly distributed around the circumference of the inner structure. The number and width of openings are chosen based on the predetermined characteristics desired for the longitudinal harmonic electric field superimposed with a rotating electric field. The openings in the inner structure allow the electrical potential resulting from the application of electrical voltages to the outer structure to penetrate into the area inside the inner structure. The number of openings in each region is equivalent and can range from 2 to 16 openings, 2 to 8 openings, or preferably, 2 to 4 openings.

The dimensions of the openings in the inner structure arc dependent generally on the length of the area over which dynamic confinement of charged particles is desired. In general, the length of the openings in each of the regions of the inner structure should be large enough to achieve the longitudinal harmonic electric field superimposed with a rotating electric field over the area of the apparatus desired. The length of the openings is generally as long as permissible. The length of each of the openings is at least about 30%, at least about 40%, at least about 50%, at least about 60%, at least about 70%, or at feast about 80%, of the length of the region in which the opening is disposed.

Accordingly, the shape of the openings is elongated so that the longest dimension of the opening (i.e., the length) is along the longitudinal axis of the inner structure, while the width is perpendicular to the longitudinal axis of the inner structure. The length of the opening is at least about 100% larger than, about 200% to about 500% larger than, or 200% to about 5000% larger than, the width of the opening.

The openings within each region have approximately equal dimensions, which means that the dimensions vary by less than about 20%, by less than about 10%, and less than about 5%. In general, the openings are substantially rectangular in shape, however, the shape of the openings can include other polygonal shapes as well as circular or elliptical shapes.

The openings in each region are positioned on the inner structure as if the openings of each region are rotated about the longitudinal axis of the inner structure by a constant rotation angle relative to the openings in the previous region. In other words, the openings in each region are shifted about the longitudinal axis so that the openings of each subsequent region are offset a distance, which is correlated with the constant angle of rotation, from the openings of the previous region. Thus, a rotation or shift of the openings of the one region to the openings of the next region can be observed. The rotation of the openings in each subsequent region progresses so that the openings of the first region and the last region are substantially aligned (see FIGS. 3A–4B). In another embodiment the first region, one or more middle regions, and the last region are substantially aligned (see FIGS. 5A–5C). In still another embodiment, the openings of the first region and the last region are not substantially aligned (not shown) .

The relative position of the openings in combination with the dimensions of the openings facilitates the production of the longitudinal harmonic electric potential field superimposed with the rotating electric potential field. In one embodiment, the longitudinal harmonic electric potential field superimposed with the rotating electric potential field can be made using a single radio frequency source. The use of one RF source is economically advantageous and less complex (e.g., structurally and electrically) than using two or more RF sources.

In particular, if the RF ion guide has a number of openings (N), a rotation angle ($\Phi_N$) that is constant (constant rotation angle) from region to region, and the number of regions (n) is an integer, then the openings of the first region and last region are substantially aligned if the following equation is satisfied: $\Phi_N=2\pi/(N\times n)$. Consequently, for an adjacent region, the RF waveforms in all axial directions are phase-shifted by $\phi_n$, which is directly correlated to number of the regions (i.e., $\phi_n=2\pi/n$). The RF waveform applied to the RF ion guide is generally given by the formula: $V=V_0 \cos[\omega t]$, where V is the voltage on the inner structure, $V_0$ is amplitude of the applied RF voltage, $\omega$ is the frequency, and t is ion travel time through n sections. The RF waveform within the first region is also $V_1=V_0 \cos[\omega t]$, and the RF waveforms within each of the following regions can be then expressed as: $V_2=V_0 \cos[\omega t+\phi_n]$, $V_3=V_0 \cos[\omega t+2\phi_n]$, . . . and $V_2=V_0 \cos[\omega t+(n-1)\Phi_n]$, at any given moment for the second, the third, and n regions, respectively. It should be noted that the RF waveform phase shift is independent of the number of the openings in each region.

The shift of the position of the openings from region to region creates the rotating RF field. The rotating RF field possesses a frequency that can be defined as: $\omega'=2\pi/(n*t_n)$ or $\omega'=(2\pi/n)(v/L_n)$, where t is the ion travel time through n regions, v is the travel velocity, and $L_n$ is the length of each region, respectively. Thus, the rotation frequency ($\omega'$) is independent of the initial RF frequency ($\omega$) even though it is generated from the initial RF voltage. The rotation field is superimposed on the existing RF field and can be correlated to the number of the openings, the length of the openings, and axial velocity of the charged particles. Consequently, the charged particle experiences harmonic oscillation caused by the initial RF field that is overlapped with the helical motion caused by the rotating field.

As indicated above, the number of regions can range from 1 to 300 and the number of openings in each region can range from 2 to 16. The angle of rotation can be calculated from the number of regions, as discussed above. In general, the angle of rotation (constant rotation angle) can range from about 1° to 45°, 2.5° to 30°, or 5° to 15°. In particular, the angle of rotation is about, 30°, 15°, 7.5°, or 2.5°.

The longitudinal harmonic electric potential field superimposed with a rotating electric potential field generated may include a number of sub-fields. The number of sub-fields is directly related to the number of openings in the inner structure. The polarity and magnitude of the sub-fields may differ and depend on the size of the inner structure and the outer structure, the opening in the inner structure, and the voltages applied to the inner structure and the outer structure, as well other structural parameters.

In one embodiment, the potential field and the sub-fields have alternating polarity such as alternating positive and negative character where the reference is ground. However, the term "alternating polarity" includes the situation where the polarities of the sub-fields both have the same positive or negative character such as in the case of a DC offset where ground is offset by a component such as a DC voltage. The longitudinal harmonic electric potential field superimposed with a rotating electric potential field arises from the application of generally opposing electrical voltages to the outer structure and inner structure.

As indicated above, the RF ion guide can be used to manipulate charged particles. Operations for manipulating charged particles in the RF ion guide include, for example, transportation of ions, collisional cooling of ions, collisional fragmentation of ions, collisional focusing of ion beams, and ion trapping. The term "charged particles" means particles that exhibit an overall charge greater or less than neutral. Such charged particles include, for example, positively and negatively charged particles, electrons, protons, positrons, singularly charged particles, multiply charged particles, atomic ions, and molecular ions.

For example, a beam of charged particles, such as an ion beam sent axially through the inner structure of the RF ion guide, experiences harmonic oscillation caused by the initial RF field that is overlapped with the helical motion caused by the rotating field, which vary in time and space. The motion of the charged particles in such a field can be described as having a helical rotation overlapped with a harmonic oscillation. This motion causes the charged particles to be focused (narrowing of the ion beam) as they travel through the RF ion guide. Consequently, the bean of charged particles can be transmitted over a long distance (in mass spectrometry application, the distance usually ranges from 10 cm to 50 cm) without significant loss, which is important for achieving high instrument sensitivity.

Furthermore, the present invention allows generation of oscillating electric potential fields having predetermined characteristics, which can be tailored to the needs of the artisan by controlling the dimensions of apparatus in accordance with the embodiments of the present invention as well as voltages applied to the inner and outer structures.

The inner structure and the outer structure are constructed from materials that are electrically conductive such as, for example, metals and alloys, metallized components coated with a metal or metal alloy thereof. In particular, the inner structure and the outer structure can be constructed of stainless steel, aluminum, aluminum alloy, brass, coated glass, coated ceramic, and coated plastic.

As indicated above, the inner structure is positioned within the outer structure. The inner structure and the outer structure are electrically isolated to permit independent application of voltages. The inner structure and the outer structure may be positioned relative to one another and also electrically isolated using nonconductive structures, such as, but not limited to, spacing rods, strips, posts, and O-rings. The non-conductive structures can be made of non-conductive materials such as, but not limited to, ceramics, glasses, polyimides, Teflon™, and rubbers.

The dimensions of the inner structure and the outer structure are directly related to, and generally governed by, the particular use of the apparatus. In general, the inner structure and the outer structure are of approximately equal length. In addition, the ends of the inner structure and the outer structure may be coplanar or non-coplanar. The inner dimensions of the outer structure are sufficient to permit the inner structure to be disposed therein. The inner structure and the outer structure are substantially coaxially aligned. The inner structure and the outer structure can have circular, elliptical, or polygonal shapes. In one embodiment the inner structure and the outer structure are substantially circular in shape and, thus, have a tubular shape.

The distance between the outer wall of the inner structure and the inner wall of the outer structure (otherwise referred to as a "gap") is sufficient so that the electrical potential generated from the outer structure penetrates into the electrical potential generated by the inner structure. The size of the gap is also dependent on the intensity of the applied electrical voltages.

One skilled in the art will be able to select particular electrical voltages of appropriate magnitude based on the design of the RF ion guide to achieve longitudinal harmonic electric potential field superimposed with a rotating electric potential field of desired predetermined characteristics.

Figure 2:
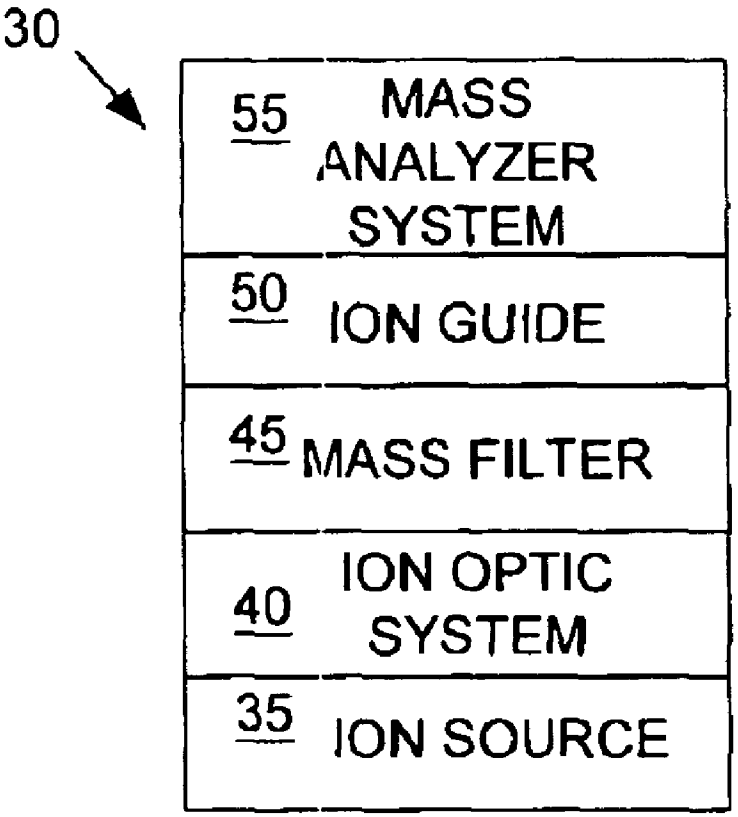
FIG. 2 is a schematic diagram of another embodiment of a mass spectrometry system.

FIG. 2 depicts another embodiment of a mass spectrometry system 30 having at least one ion guide. The mass spectrometry system 30 includes an ion source 35, ion optic system 40, a mass filter 45, an ion guide 50, and a mass analyzer system 55. The ion source 35, ion optic system 40, and the mass analyzer system 55 are similar to the corresponding ion source 15, ion optic system 20, and the mass analyzer system 25 described in reference to FIG. 1. The mass filter 45 is similar to the mass analyzer described in reference to the mass analyzer system 25 described in reference to FIG. 1. The ion guide 50 may also include electrostatic lenses to focus the fragmented ions into the mass analyzer system 55.

The ion guide 50 of mass spectrometry system 30 can be used as a collision cell to fragment ions of interest and/or as an ion trap. For example, a collision gas, usually an inert gas such as argon or helium, is introduced into the inner structure. The gas pressure typically ranges from about 1 to 10 milliTorr and more typically 2 to 5 milliTorr. Molecular ions with a kinetic energy of few eV to few hundreds eV are focused into the collision cell where they undergo collisions with the inert gas molecules. Consequently, a portion of the molecular ion is dissociated (fragmentation). Both the molecular ions and the fragment ions are confined with the inner structure due to the harmonic oscillation and molecule-molecule collisions. An additional rotating field forces the ions to take helical path resulting a longer reaction periods, and hence a higher fragmentation efficiency.

Figure 3A:
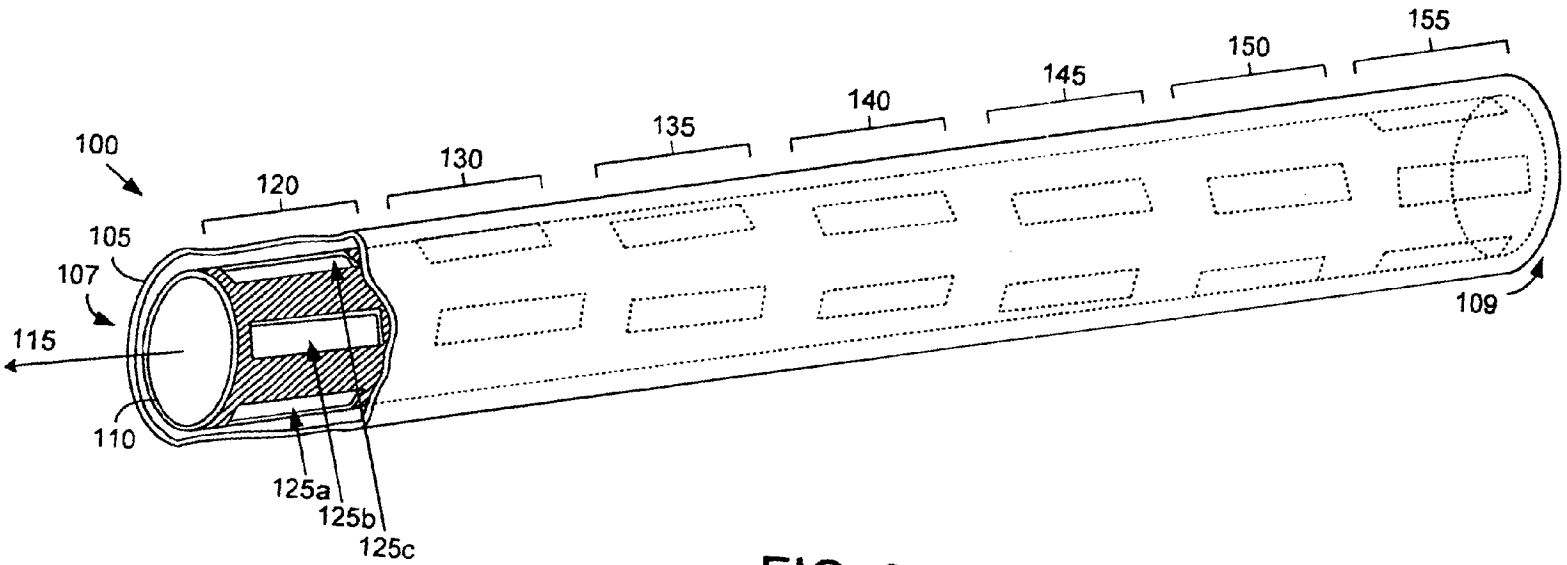
FIG. 3A is a perspective view of an exemplary embodiment of an RF ion guide.
Figure 3B:
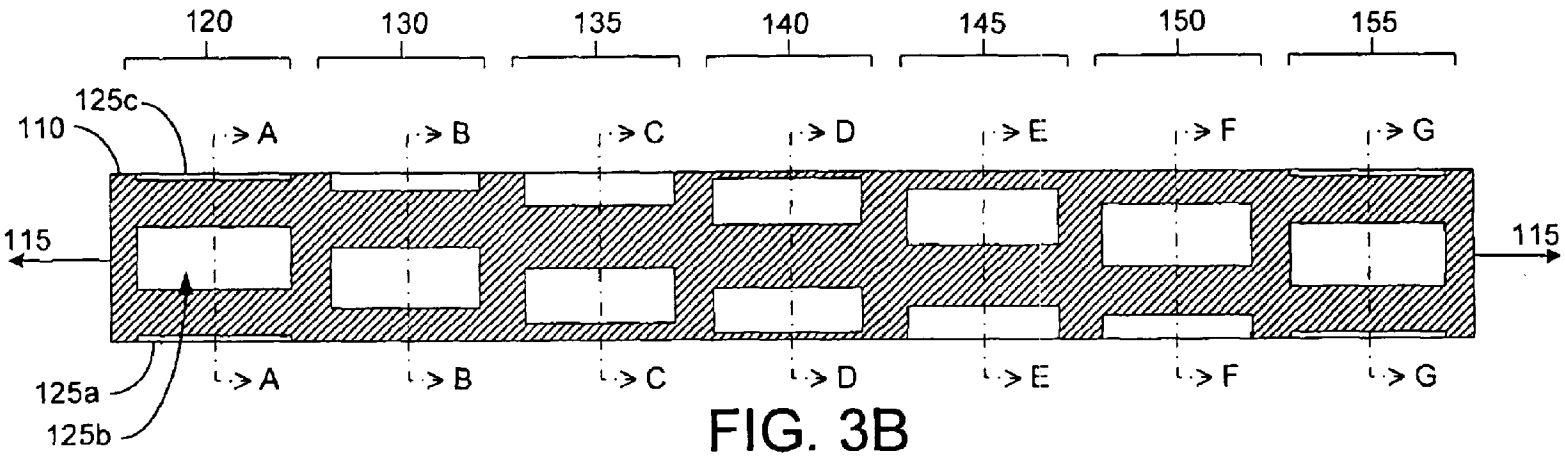
FIG. 3B is a side view of the inner structure of the RF ion guide shown in FIG. 3A and FIG. 3C includes cross sections at various positions of the inner structure of the RF ion guide of FIG. 3A.
Figure 3C:
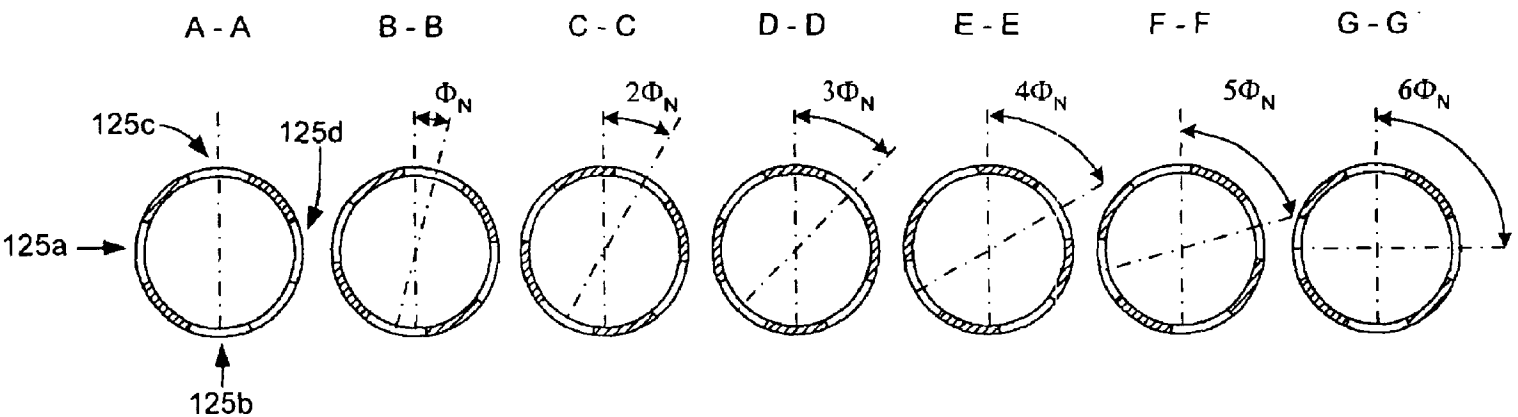

FIG. 3A is a perspective view of an exemplary embodiment of a RF ion guide 100, FIG. 3B is a side view of the inner structure 110 of the RF ion guide 100 shown in FIG. 3A and FIG. 3C includes cross sections at various positions of the inner structure 110. The RF ion guide 100 includes an outer structure 105 and an inner structure 110, which are electrically isolated. The outer structure 105 and the inner structure 110 are substantially tubular and each has an entrance opening 107 and an exit opening 109. The inner structure 110 is disposed within the outer structure 105.

The inner structure 110 includes seven regions 120, 130, 135, 140, 145, 150, and 155, where each region includes four openings in a wall of the inner structure 110. For example, the first region 120 includes four openings 125*a*, 125*b*, 125*c*, and 125*d*. The four openings in each region are disposed equidistant from one another, are substantially rectangular, and have substantially the same length and width.

As viewed from the first region 120 to the seventh region 155, the openings of each region are positioned on the inner structure 110 as if the openings of each region are rotated about the longitudinal axis 115 of the inner structure 110 by a multiple (1–6) of a constant rotation angle (Φ) relative to the openings of the first region 120. The constant rotation angle is 15 degrees so that the openings of the first region 120 and the openings of the seventh region 155 are substantially aligned, as shown in FIGS. 3B and 3C.

To illustrate this point, FIG. 3C shows cross-sections A—A, B—B, C—C, D—D, E—E, F—F, and G—G, of each region 120, 130, 135, 140, 145, 150, and 155, respectively, of the inner structure 110. For example, the position of the openings in the second region 130 is offset from the openings of the first region 120 by 15 degrees; the position of the openings in the third region 135 is offset from the openings of the first region 120 by 30 degrees; the position of the openings in the fourth region 140 is offset from the openings of the first region 120 by 45 degrees; and so forth. The position of the openings of each region shifts so that the four openings of the first region 120 and the four openings of the seventh region 155 are substantially aligned.

Figure 4A:
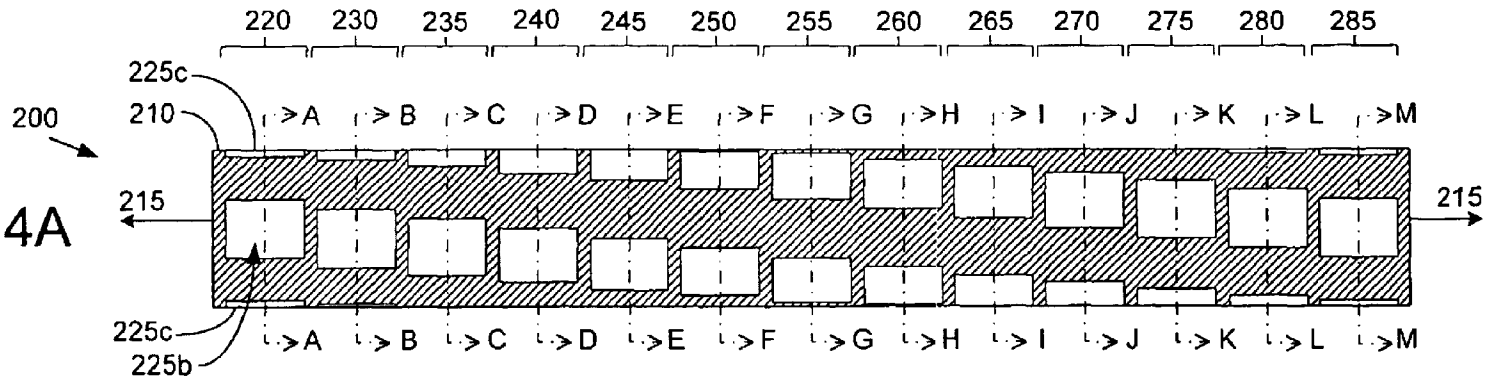
FIG. 4A is a side view of the inner structure of another embodiment of a RF ion guide and FIG. 4B includes cross sections at various positions of the inner structure of the RF ion guide of FIG. 4A.
Figure 4B:
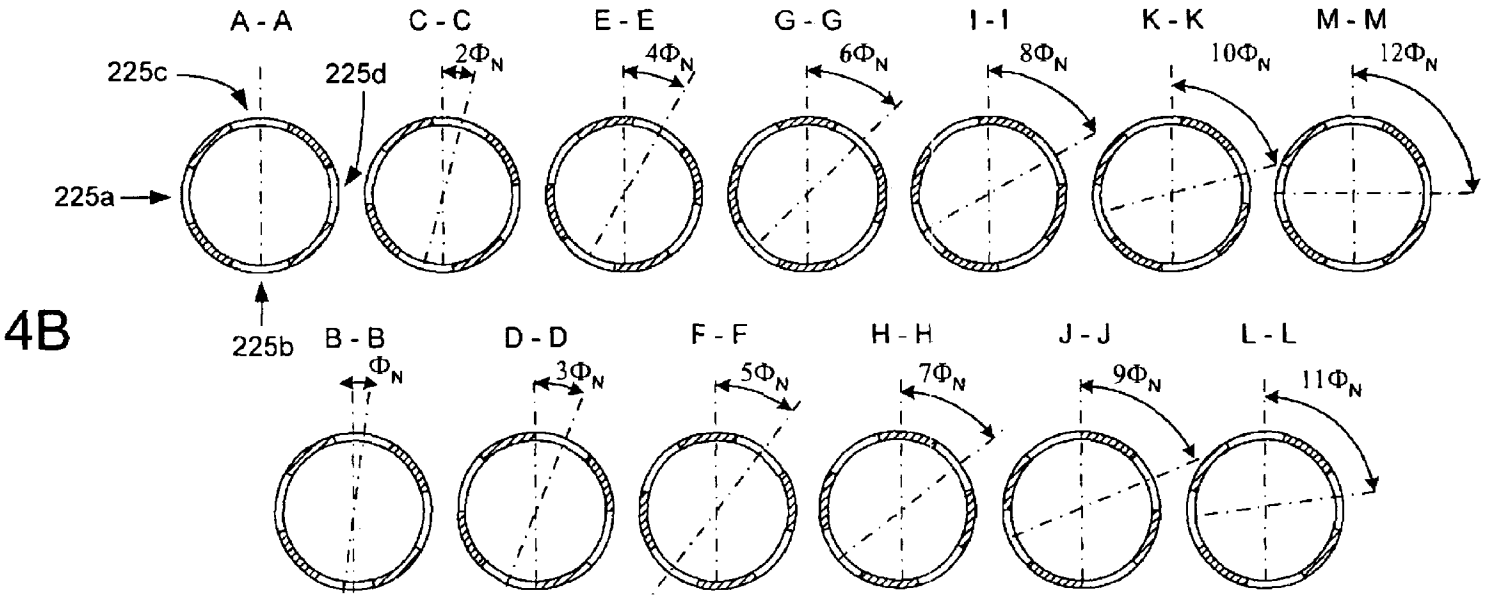

FIG. 4A is a side view of the inner structure of another representative RF ion guide 200 and FIG. 4B includes cross sections at various positions of the inner structure of the RF ion guide 200. The RF ion guide 200 includes an outer structure 205 and an inner structure 210, which are electrically isolated. The outer structure 205 and the inner structure 210 are substantially tubular and each has an entrance opening and an exit opening. The inner structure 210 is disposed within the outer structure 205.

The inner structure 210 includes thirteen regions 220, 230,235, 240, 245, 250, 255, 260, 265, 270, 275, 280, and 285, where each region includes four openings in a wall of the inner structure 210. For example, the first region 220 includes four openings 225*a*, 225*b*, 225*c*, and 225*d*. The four openings in each region are disposed equidistant from one another, are substantially rectangular, and have substantially the same length and width.

As viewed from the first region 220 to the thirteenth region 285, the openings of each region are positioned on the inner structure 210 as if the openings of each region is rotated about the longitudinal axis of the inner structure 210 by a multiple (1–12) of a constant rotation angle (Φ) relative to the openings of the first region 220. The constant rotation angle is 7.5 degrees so that the openings of the first region 220 and the openings of the thirteenth region 285 are substantially aligned.

To illustrate this point, FIG. 4B shows cross-sections A—A, B—B, C—C, D—D, E—E, F—F, G—G, H—H, I—I, J—J, K—K, L—L, and M—M, of each region 220, 230, 235, 240, 245, 250, 255, 260, 265, 270, 275, 280, and 285, respectively, of the inner structure 210. For example, the position of the openings in the second region 230 is offset from the openings of the first region 220 by 7.5 degrees; the position of the openings in the third region 235 is offset from the openings of the first region 220 by 15 degrees; the position of the openings in the fourth region 240 is offset from the openings of the first region 220 by 22.5 degrees; and so forth. The position of the openings of each region shifts so that the four openings of the first region 220 and the four openings of the thirteenth region 285 are substantially aligned.

Figure 5A:
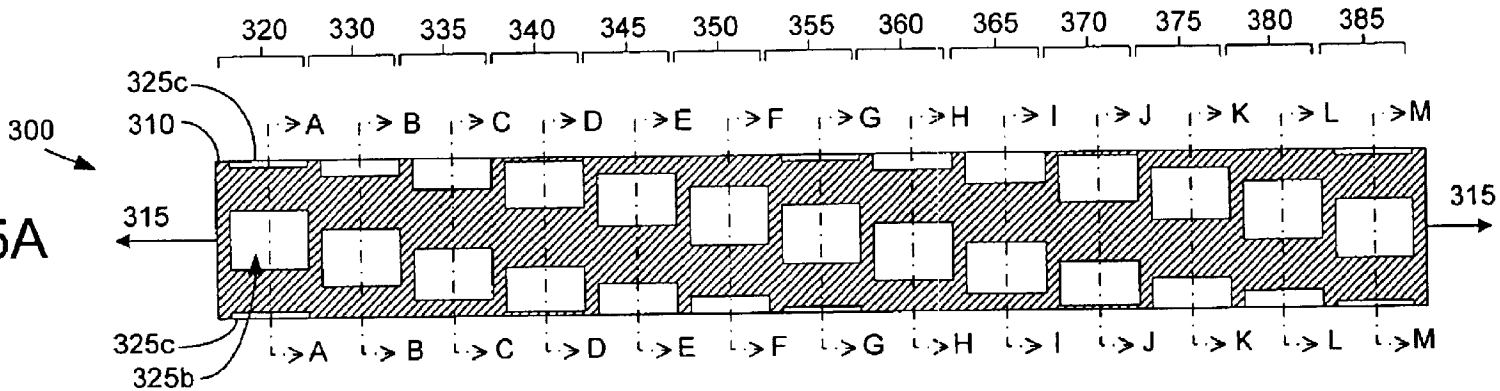
FIG. 5A is a side view of the inner structure of another embodiment of a RF ion guide and FIG. 5B includes cross sections at various positions of the inner structure of the RF ion guide of FIG. 5A.
Figure 5B:
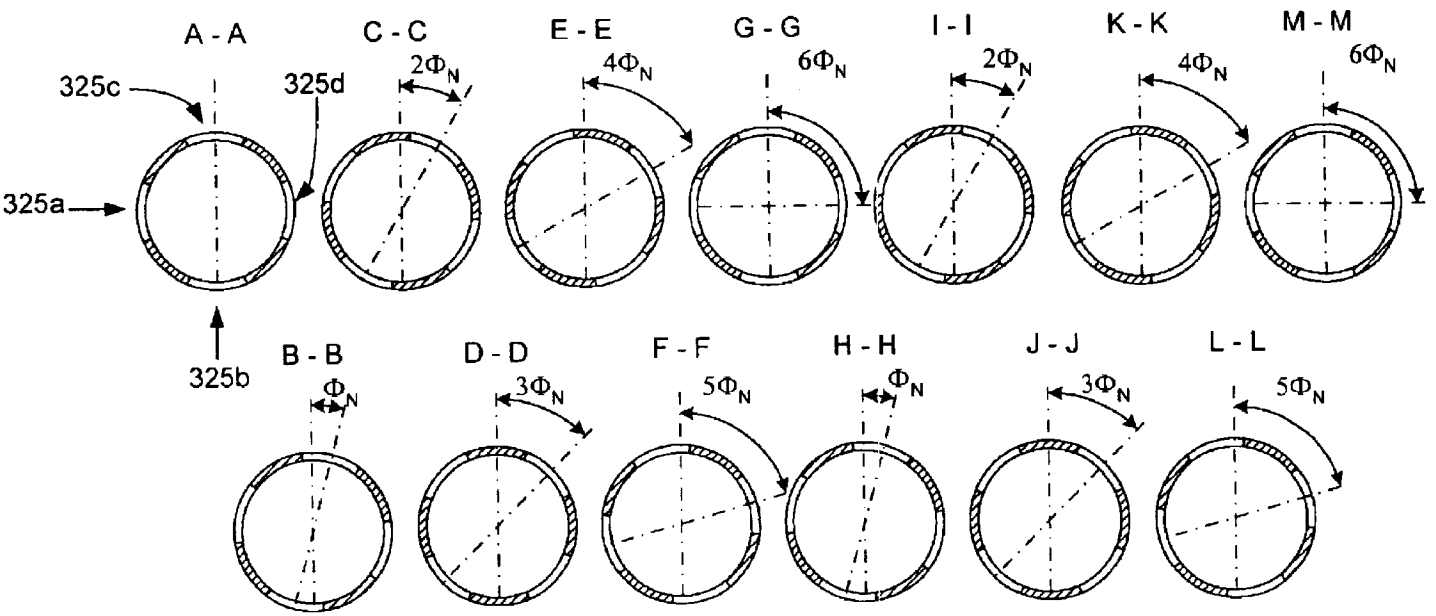

FIG. 5A is a side view of the inner structure of another representative RF ion guide 300 and FIG. 5B includes cross sections at various positions of the inner structure of the RF ion guide 300. The RF ion guide 300 includes an outer structure 305 and an inner structure 310, which are electrically isolated. The outer structure 305 and an inner structure 310 are substantially tubular and each has an entrance opening and an exit opening. The inner structure 310 is disposed within the outer structure 305.

The inner structure 310 includes thirteen regions 320, 330, 335, 340, 345, 350, 355, 360, 365, 370, 375, 380, and 385, where each include four openings in a wall of the inner structure 310. For example, the first region 320 includes four openings 325*a*, 325*b*, 325*c*, and 325*d*. The four openings in each region are disposed equidistant from one another, are substantially rectangular, and have substantially the same length and width.

As viewed from left to right or from the first region 320 to the thirteenth region 385, the openings of each region are positioned on the inner structure 310 as if the openings of each region is rotated about the longitudinal axis of the inner structure 310 by a multiple (1–6) of a constant rotation angle (Φ) relative to the openings of the first region 310. The constant rotation angle is 15 degrees so that the openings of the first region 320, the openings of the seventh region 355, and the openings of the thirteenth region 385 are substantially aligned.

To illustrate this point, FIG. 5B shows cross-sections A—A, B—B, C—C, D—D, E—E, F—F, G—G, H—H, I—I, J—J, K—K, L—L, and M—M, of each region 320, 330, 335, 340, 345, 350, 355, 360, 365, 370, 375, 380, and 385, respectively, of the inner structure 310. For example, the position of the openings in the second region 330 and the eighth region 360 are offset from the openings of the first region 320 and seventh region 355 by 15 degrees; the position of the openings in the third region 335 and ninth region 365 are offset from the openings of the first region 320 and seventh region 355 by 30 degrees; the position of the openings in the fourth region 340 and the tenth region 370 are offset from the openings of the first region 320 and seventh region 355 by 45 degrees; and so forth. In other words, the position of the openings of each region shifts so that the four openings of the first region 320, the four openings of the seventh region 355, and the four openings of the thirteenth region 385 are substantially aligned. The total length of the embodiments in FIG. 4A and FIG. 5A are of the same. However, the rotation angle of the embodiment in FIG. 5A is twice of that in FIG. 4A (15° and 7.5°, respectively). Consequently, the rotation frequency generated by the embodiment in FIG. 5A is twice of that generated by embodiment in FIG. 4A for the ions of the same velocity.

Figure 6A:
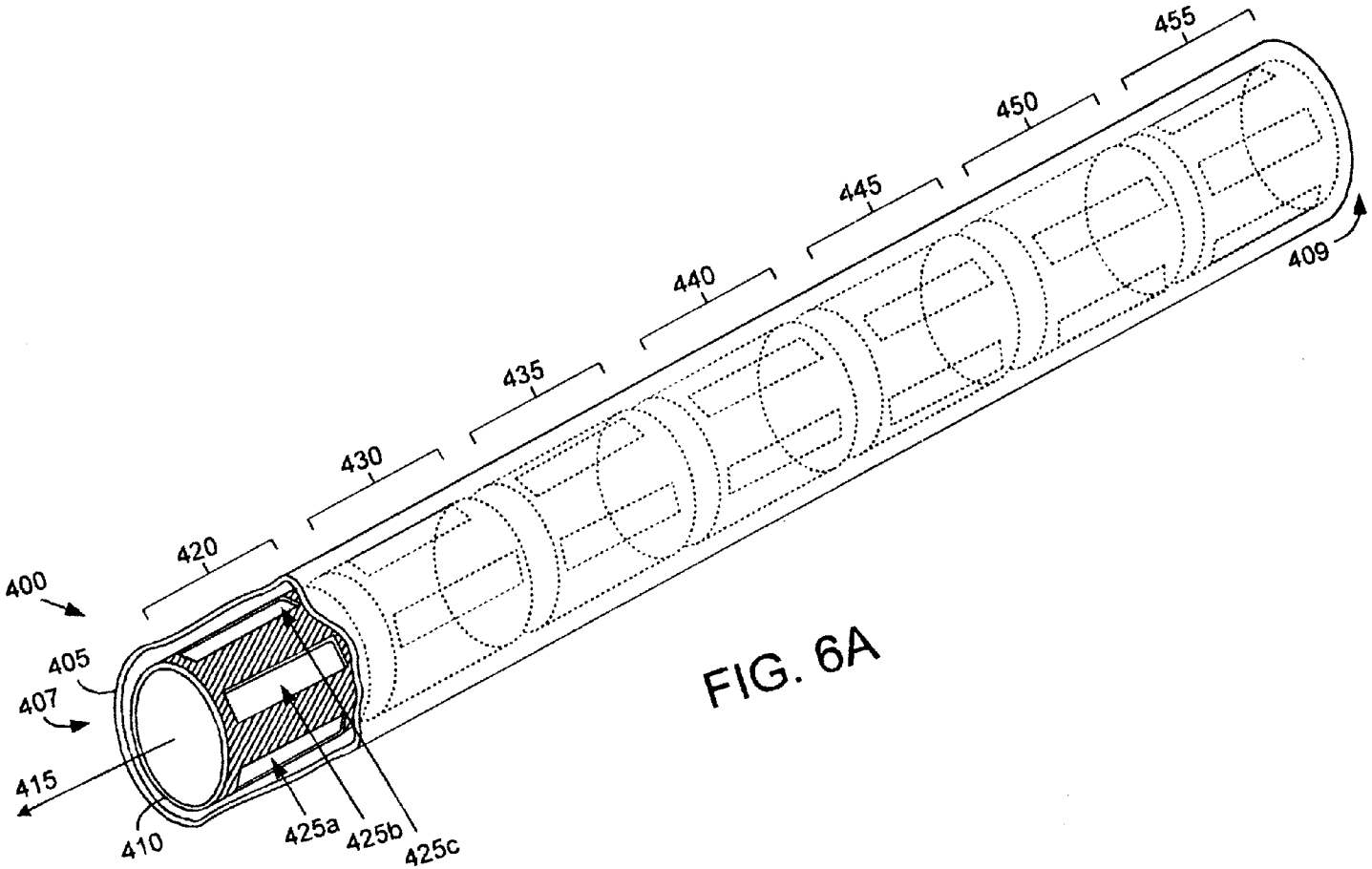
FIG. 6A is a perspective view of an exemplary embodiment of a RF ion guide.
Figure 6B:
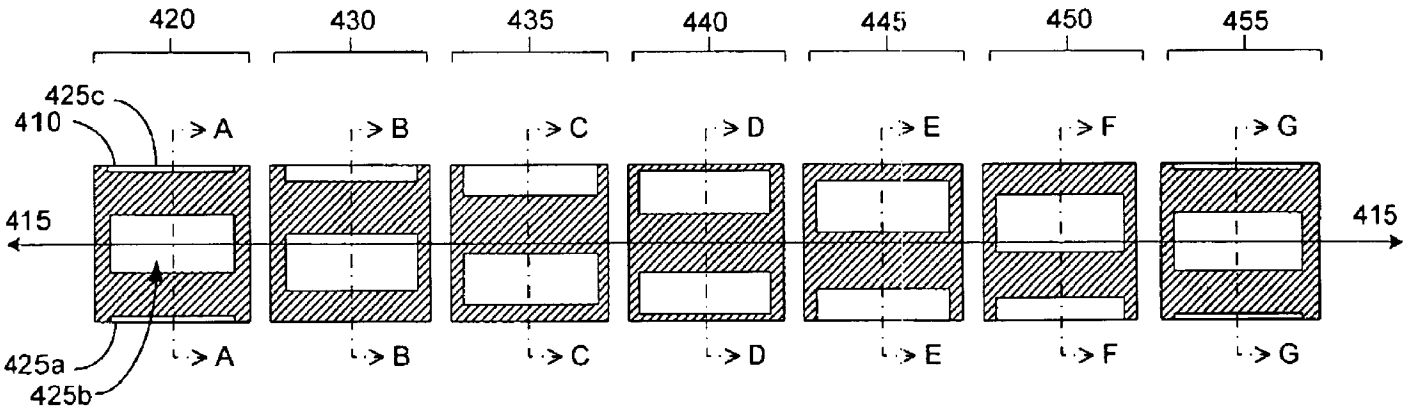
FIG. 6B is a side view of the inner structure of the RF ion guide shown in FIG. 6A and FIG. 6C includes cross sections at various positions of the inner structure of the RF ion guide of FIG. 6A.
Figure 6C:
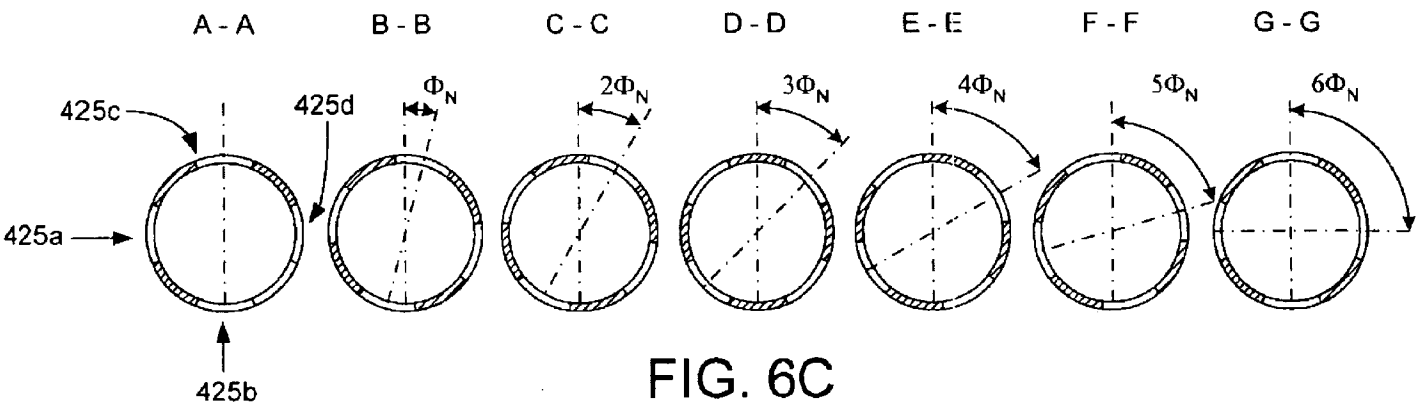

FIG. 6A is a perspective view of an exemplary embodiment of a RF ion guide 400, while FIG. 6B is a side view of the inner structure of the RF ion guide 400 shown in FIG. 6A and FIG. 6C includes cross sections at various positions of the inner structure of the RF ion guide 400. The RF ion guide 400 includes an outer structure 405 and an inner structure 410, which are electrically isolated. The outer structure 405 and an inner structure 410 are substantially tubular and each has an entrance opening 407 and an exit opening 409. The inner structure 410 is disposed within the outer structure 405.

The inner structure 410 includes seven electrically isolated segments 420, 430, 435, 440, 445, 450, and 455, that have substantially the same length, width, and thickness. The seven electrically isolated segments 420, 430, 435, 440, 445, 450, and 455, are isolated using non-conductive structures as discussed above in reference to the electronic isolation of the inner structure and the outer structure. The electrically isolated segments allow the use of different DC bias voltages to generate an axial field gradient, in addition to the applied RF field and resultant rotating field. The additional axial field gradient can be used to determine collision energy, accelerate ions, and for ion storage.

Each segment includes four openings in a wall of the inner structure 410. For example, the first segment 420 includes four openings 425*a*, 425*b*, 425*c*, and 425*d*. The four openings in each region are disposed equidistant from one another, are substantially rectangular, and have substantially the same length and width.

As viewed from the first segment 420 to the seventh segment 455, the openings of each region are positioned on the inner structure 410 as if the openings of each segment are rotated about the longitudinal axis of the inner structure 410 by a multiple (1–6) of a constant rotation angle (Φ) relative to the openings of the first segment 410. The constant rotation angle is 15 degrees so that the openings of the first segment 410 and the openings of the seventh segment 455 are substantially aligned.

To illustrate this point, FIG. 6C shows cross-sections A—A, B—B, C—C, D—D, E—E, F—F, and G—G, of each region 420, 430, 435,440, 445, 450, and 455, respectively, of the inner structure 410. For example, the position of the openings in the second region 430 is offset from the openings of the first region 420 by 15 degrees; the position of the openings in the third region 435 is offset from the openings of the first region 420 by 30 degrees; the position of the openings in the fourth region 440 is offset from the openings of the first region 420 by 45 degrees; and so forth. The position of the openings of each region shifts so that the four openings of the first region 420 and the four openings of the seventh region 455 are substantially aligned.

In addition to the RF voltages, when bias DC voltages $U_1$, $U_2$, $U_3$, $U_4$, $U_5$, $U_6$ and $U_7$ with $U_1>U_2>U_3>U_4>U_5>U_6>U_7$ are applied to the segments 420, 430, 435, 440, 445, 450 and 455, respectively, an accelerating filed is established along the axis of the inner structure. In a collision cell, such as one illustrated in FIG. 3A, ions lose a portion of their kinetic energy due to ion-gas collision and this may result in blockage of the ion beam. The accelerating field can be used to accelerate the ions to "make-up" the energy loss, which therefore enhances the ion transmission in the cell. In contrast, deceleration voltages $U_1<U_2<U_3<U_4<U_5<U_6<U_7$ can also be applied to the segments 420, 430, 435, 440, 445, 450 and 455 to decelerate the ions as they enter the collision cell. This feature is used if the energy of the ions to be fragmented is higher than desirable collision energy.

In another embodiment, the ion guide 400 can be used as a collision cell and/or for ion trapping. When the ion guide 400 is used as an ion storage device (ion trapping), higher DC voltages are applied to the segments 420, 455 or 420, 430, 450 and 455 so a potential well is created in the center region (435, 440, 445) of the inner structure 410. Ions can be accumulated for a period of time (from few microseconds to few seconds). Ion accumulation may be useful for some dynamic mass spectrometric applications, such as, for example, time-of-flight mass spectrometry (TOF-MS) or Fourier Transform Ion Cyclotron mass spectrometry, to enhance the duty cycle of the mass spectrometry system.

It should be emphasized that the above-described embodiments are merely possible examples of implementations. Many variations and modifications may be made to the above-described embodiments. All such modifications and variations are intended to be included herein within the scope of this disclosure and protected by the following claims.

I claim:

1. A mass spectrometry system, comprising:

an ion guide having a first tubular structure and a second structure, the second structure being coaxially disposed within the first tubular structure, the second structure including a first region, at least one middle region, and a last region, each said region including at least two openings through a wall of the second structure, each of the openings being distributed around a circumference of the second structure, and the openings of the middle region being rotationally offset with respect to the openings of the first region by a multiple of a constant rotation angle.

2. The mass spectrometry system of claim 1, wherein the first tubular structure and the second structure are adapted to independently receive a radio frequency voltage to generate within the second structure an oscillating electric potential field having predetermined characteristics and a rotating electric potential field superimposed on the oscillating electric potential field having predetermined characteristics.

3. The mass spectrometry system of claim 1, wherein the number of the middle regions is greater than 1, wherein the openings of each middle region are offset from the openings of the other middle regions by a multiple of the constant rotation angle.

4. The mass spectrometry system of claim 1, wherein the openings of the first region and the openings of the last region are substantially longitudinally aligned.

5. The mass spectrometry system of claim 1, wherein the openings of the first region and the openings of the last region are not substantially longitudinally aligned.

6. The mass spectrometry system of claim 3, wherein the openings of each middle region are not substantially longitudinally aligned.

7. The mass spectrometry system of claim 1, wherein the rotation angle is in the range from about 1 to 45 degrees.

8. The mass spectrometry system of claim 1, wherein the number of the middle regions is in the range from 1 to 300.

9. The mass spectrometry system of claim 1, wherein the number of openings is in the range from 2 to 16.

10. The mass spectrometry system of claim 1, wherein adjacent openings in each region are disposed substantially equidistant from one another.

11. The mass spectrometry system of claim 1, wherein the first region, the middle regions, and the last region tubular structure and the second structure are electrically isolated from one another.

12. The mass spectrometry system of claim 11, wherein the first tubular structure and the second structure are adapted to independently receive a voltage.

13. The mass spectrometry system of claim 1, wherein the first region, the middle regions, and the last region have substantially the same length.

14. An ion guide, comprising:

a first tubular structure, and a second structure being coaxially disposed within the first tubular structure, the second structure including at least three groups of openings through a wall of the second structure that are distributed around a circumference of the second structure, at least one of the groups of openings being rotationally offset from the other groups of openings by a multiple of a constant rotation angle.

15. The ion guide of claim 14, wherein the first tubular structure and the second structure are adapted to independently receive a radio frequency voltage that produces an oscillating electric potential field having predetermined characteristics and a rotating electric potential field superimposed on the oscillating electric potential field having predetermined characteristics within the second structure.

16. The ion guide of claim 14, wherein the angle of rotation is in the range from about 1 to 45 degrees.

17. The ion guide of claim 14, wherein the number of openings in each group of openings is in the range from 2 to 16.

18. The ion guide of claim 14, wherein the number of the at least three groups is in range from 3 to 300.

19. A method of focusing ions in a mass spectrometry system, comprising:

forming an oscillating electric potential field having predetermined characteristics;

forming a rotating electric potential field superimposed on the oscillating electric potential field having predetermined characteristics; and introducing the ions to the oscillating electric potential field and the rotating electric potential field.

20. The method of claim 19, further comprising:

forming a potential well; and accumulating the ions for a specified time period.

21. The method of claim 19, wherein forming comprises:

forming the oscillating electric potential field and the rotating electric potential field are formed in a radio frequency ion guide.

22. The method of claim 21, wherein applying a voltage comprises:

applying a voltage to the ion guide having a first tubular structure and a second structure, wherein the second structure is disposed within the first tubular structure, and wherein the second structure includes at least three groups of openings through a wall of the second structure that are distributed around a circumference of the second structure, and wherein at least one of the groups of openings is rotationally offset from the other groups of openings by a multiple of a constant rotation angle.

23. The method of claim 22, wherein forming comprises:

forming the oscillating electric potential field and the rotating electric potential field within the second structure.

24. A mass spectrometry system, comprising:

means for forming an oscillating electric potential field having predetermined characteristics and a rotating electric potential field superimposed on the oscillating electric potential field having predetermined characteristics.

* * * * *